US011798326B2

(12) United States Patent
Nakagawa

(10) Patent No.: US 11,798,326 B2
(45) Date of Patent: Oct. 24, 2023

(54) SYSTEMS AND METHODS FOR ACCESSING PROTECTED VEHICLE ACTIVITY DATA

(71) Applicant: Toyota Motor Engineering & Manufacturing North America, Inc., Plano, TX (US)

(72) Inventor: Masashi Nakagawa, Sunnyvale, CA (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 246 days.

(21) Appl. No.: 17/324,925

(22) Filed: May 19, 2021

(65) Prior Publication Data

US 2022/0375283 A1 Nov. 24, 2022

(51) Int. Cl.
*G07C 5/08* (2006.01)
*G07C 9/00* (2020.01)

(52) U.S. Cl.
CPC ..... *G07C 5/0841* (2013.01); *G07C 5/0808* (2013.01); *G07C 9/00309* (2013.01)

(58) Field of Classification Search
CPC ..... G07C 5/0841; G07C 5/0808; G07C 9/00309; G07C 5/0866; G07C 2009/00507
See application file for complete search history.

(56) References Cited

U.S. PATENT DOCUMENTS

2011/0066317 A1* 3/2011 Lee ..... G07C 5/0866 701/31.4
2016/0173882 A1* 6/2016 Mishra ..... H04N 19/426 375/240.08
2018/0262336 A1* 9/2018 Fujiwara ..... G07C 9/00857
2018/0354460 A1* 12/2018 Bartels ..... G07C 9/00896
2019/0028443 A1* 1/2019 Chin ..... G07C 9/00571
2019/0156605 A1* 5/2019 Tang ..... G06Q 30/0645
2020/0380801 A1* 12/2020 MacNeille ..... H04L 9/3236

FOREIGN PATENT DOCUMENTS

WO WO-2015023241 A1 * 2/2015 ..... G07C 5/008
WO WO-2019004097 A1 * 1/2019 ..... G06F 21/31

* cited by examiner

*Primary Examiner* — Joseph J Dallo
(74) *Attorney, Agent, or Firm* — SNELL & WILMER LLP

(57) ABSTRACT

Systems and methods for accessing protected activity data of a vehicle. A system may include a vehicle key and a user key. The vehicle key may be configured to be managed by a manufacturer of the vehicle. The user key may be configured to be managed by a user of the vehicle. The vehicle key and the user key may decrypt the vehicle activity data when used together. The system may include a third-party key configured to be managed by a third-party and decrypt the vehicle activity data. The vehicle key and the user key may modify the vehicle activity data when used together. Alternatively, the vehicle key, the user key, and the third-party key may modify the vehicle activity data when used together.

20 Claims, 6 Drawing Sheets

SYSTEMS AND METHODS FOR ACCESSING PROTECTED VEHICLE ACTIVITY DATA

BACKGROUND

1. Field

The present disclosure is directed to systems and methods for accessing protected or encrypted vehicle activity data.

2. Description of the Related Art

Vehicles (e.g., automobiles, motorcycles, trucks, motorhomes, etc.) may record and store data pertaining to vehicle activity, such as how the vehicle is driven, exterior and/or interior video footage, vehicle statistics, and accident data. The vehicle activity data may be stored locally or on a server. The vehicle activity data may reveal important information when determining the cause of an accident, whether the user of the vehicle committed a crime or a traffic violation, and vehicle insurance pricing and claims by example. It may be necessary to investigate and/or make changes to the vehicle activity data. Ensuring the integrity of the vehicle activity data is imperative in such circumstances.

As such, there is a need for systems and methods for accessing protected vehicle activity data.

SUMMARY

Systems and methods for accessing protected activity data of a vehicle are disclosed. A system may include a vehicle key and a user key. The vehicle key may be managed by a manufacturer of the vehicle. The user key may be managed by a user of the vehicle. The vehicle key and the user key may decrypt the vehicle activity data when used together. In some embodiments, the vehicle key and the user key may modify the vehicle activity data when used together. The system may further include a third-party key that may be managed by a third-party. The third-party key may decrypt the vehicle activity data. In some embodiments, the vehicle key, the user key, and the third-party key may modify the vehicle activity data when used together.

A system for accessing protected activity data of a vehicle may have a vehicle key and a user key. The vehicle key may be configured to be managed by a manufacturer of the vehicle. The user key may be configured to be managed by a user of the vehicle and decrypt the vehicle activity data when used in conjunction with the vehicle key. The vehicle key and the user key may be further configured to modify the vehicle activity data when used together. The system may further have a third-party key configured to be managed by a third-party and decrypt the vehicle activity data. The vehicle activity data may include driving footage, vehicle information, or accident information.

The system may further have an electronic control unit (ECU) configured to register the vehicle activity data onto a memory or a server. The ECU may be further configured to encrypt the vehicle activity data. The ECU may be further configured to timestamp the vehicle activity data.

The ECU may be further configured to generate a digest data from the vehicle activity data. The digest data may be used to detect unauthorized modification of the vehicle activity data by the manufacturer, the user, or a third-party. The digest data may be protected by the vehicle key and the user key.

A system for accessing protected activity data of a vehicle may have a vehicle key, a user key, and a third-party key. The vehicle key may be configured to be managed by a manufacturer of the vehicle. The user key may be configured to be managed by a user of the vehicle. The third-party key may be configured to be managed by a third-party and modify the vehicle activity data when used in conjunction with the vehicle key and the user key. The third-party key may be further configured to decrypt the vehicle activity data. The vehicle key and the user key may further decrypt the vehicle activity data when used together. The vehicle activity data may include driving footage, vehicle information, or accident information.

The system may further have an electronic control unit (ECU) configured to register the vehicle activity data onto a memory or a server. The ECU may be further configured to encrypt the vehicle activity data. The ECU may be further configured to timestamp the vehicle activity data.

A method for accessing protected vehicle activity data may include providing a vehicle key configured to be managed by a manufacturer of the vehicle. The method may further include providing a user key configured to be managed by a user of the vehicle. The method may further include decrypting, by the vehicle key and the user key, the vehicle activity data.

The method may further include modifying, by the vehicle key and the user key, the vehicle activity data. The method may further include providing a third-party key configured to be managed by a third-party, and modifying, by the vehicle key, the user key, and the third-party key, the vehicle activity data.

The method may further include registering, by an electronic control unit (ECU), the vehicle activity data onto a memory or a server. The method may further include encrypting, by the ECU, the vehicle activity data. The method may further include timestamping, by the ECU, the vehicle activity data.

Private data of the vehicle activity data such as video or voice recordings recorded inside the vehicle may be decrypted and accessed only by the user using the using key without disclosure of the private data to the manufacturer or the third-party.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale and may be exaggerated to better illustrate the important features of the present invention.

DETAILED DESCRIPTION

The systems and methods described herein access protected activity data of a vehicle. The systems and methods may utilize a vehicle key, a user key, and a third-party key. The vehicle key may be managed by a manufacturer of the vehicle, the user key may be managed by a user of the vehicle, and the third-party key may be managed by a third-party. The term "user" or "driver" may be interchanged with "passenger" when referring to autonomous or semi-autonomous vehicles. In some embodiments, the vehicle key and the user key may decrypt and/or modify the vehicle activity data when used together. The third-party key may decrypt the vehicle activity data by itself. In some embodiments, the vehicle key, the user key, and the third-party key may modify the vehicle activity data when used together. "Together" may mean simultaneously or sequentially. Vehicle activity data may include driving footage, vehicle information, or accident information. Thus, the vehicle, key, the user key, and the third-party key may advantageously prevent unauthorized access or viewing and/or modification of the vehicle activity data.

Figure 1:
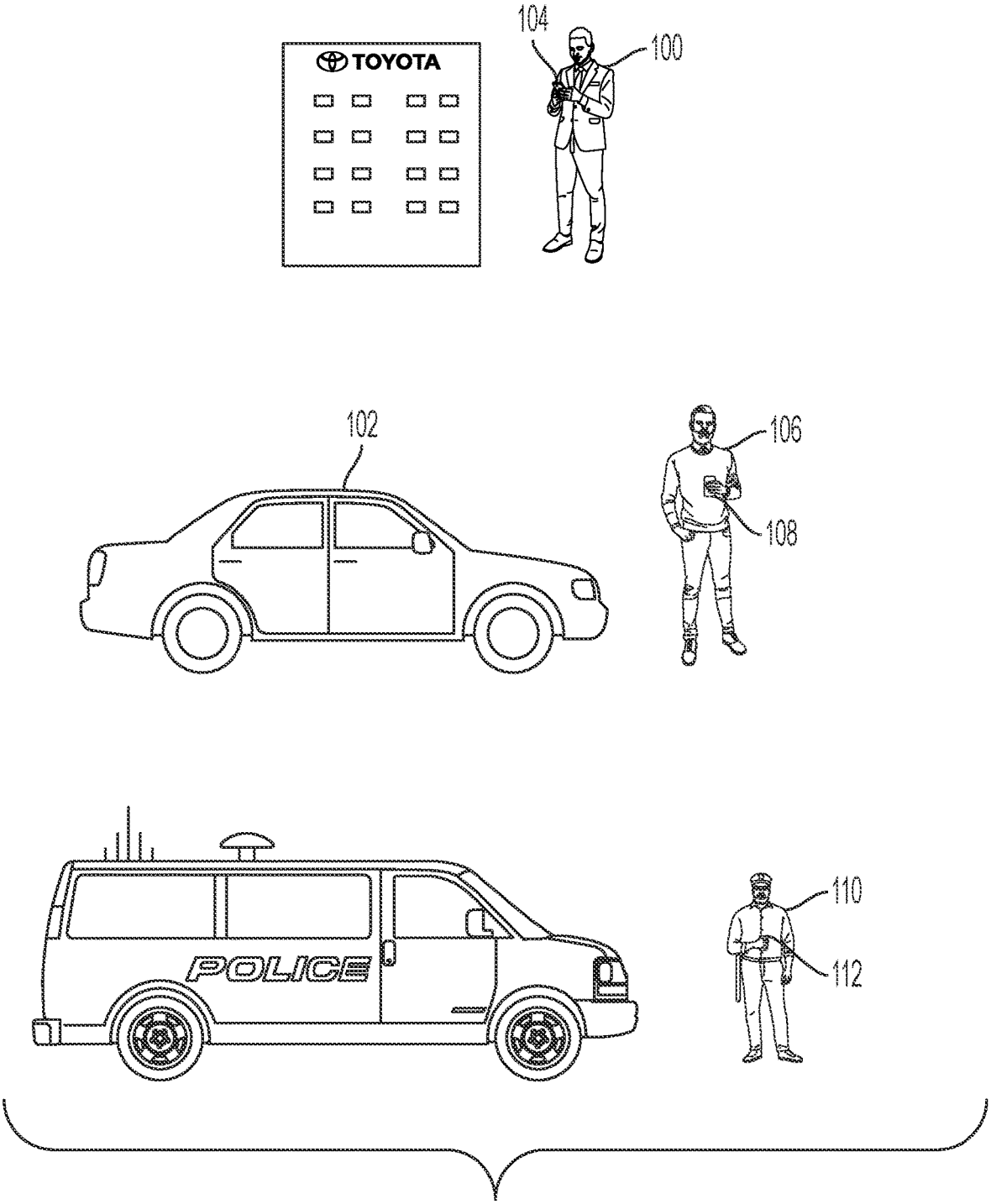
FIG. 1 illustrates a manufacturer of a vehicle having a vehicle key, a user of the vehicle having a user key, and a third-party having a third-party key according to an aspect of the present disclosure.

FIG. 1 illustrates a manufacturer 100 of a vehicle 102 having a vehicle key 104, a user 106 of the vehicle 102 having a user key 108, and a third-party 110 having a third-party key 112 according to an aspect of the present disclosure. The manufacturer 100 may produce or order the production of the vehicle key 104, the user key 108, and the third-party key 112. The manufacturer 100 may distribute or authorize the distribution of the user key 108 and the third-party key 112 to the user 106 and the third-party 110, respectively. The manufacturer 100 may further distribute or authorize the distribution of the vehicle key 104 to a distributor, a seller, or an authorized reseller of the vehicle 102. The user 106 may receive the user key 108 upon purchase, lease, or rental of the vehicle 102. The third-party 110 may receive the third-party key 112 upon production, purchase, lease, or rental of the vehicle 102. For example, the third-party 110 may be law enforcement (e.g., state police, federal bureau, military, etc.), a rideshare company, an insurer of the user 106, the vehicle 102 and/or its components. A police officer is shown in FIG. 1 by example. In some embodiments, the vehicle key 104, the user key 108, and the third-party key 110 may be a password or a passcode including letters, numbers, shapes, patterns, symbols, etc.

Figure 2:
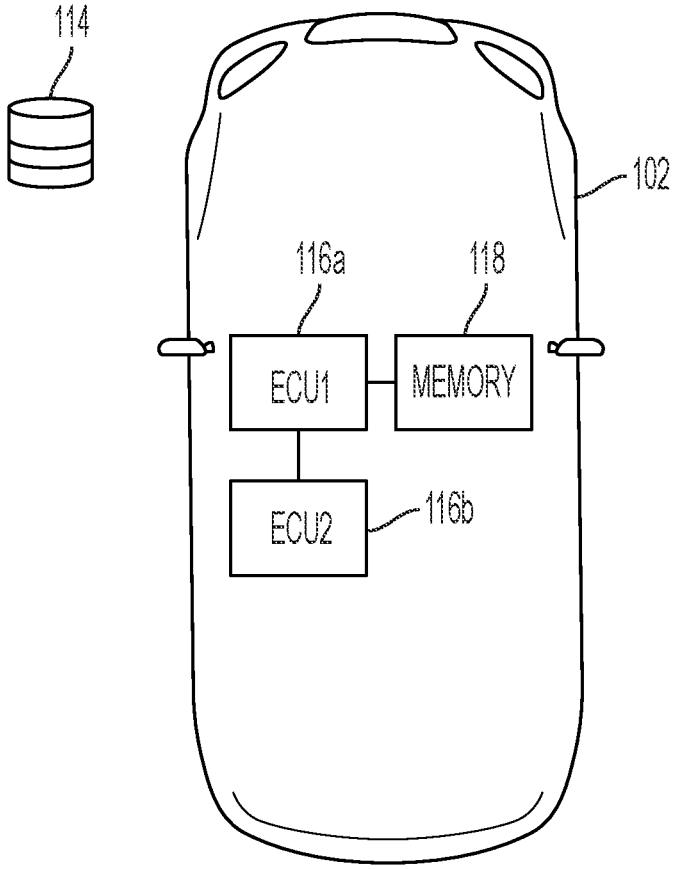
FIG. 2 illustrates a block diagram of the vehicle of FIG. 1 communicating with a server according to an aspect of the present disclosure.

FIG. 2 illustrates a block diagram of the vehicle 102 communicating with a server 114 according to an aspect of the present disclosure. The vehicle 102 is a conveyance capable of transporting a person, an object, or a permanently or temporarily affixed apparatus. The vehicle 102 may have an automatic or manual transmission. The vehicle 102 may be a self-propelled wheeled conveyance, such as a car, an SUV, a truck, a bus, a van or other motor or battery driven vehicle. For example, the vehicle 102 may be an electric vehicle, a hybrid vehicle, a plug-in hybrid vehicle, a fuel cell vehicle, or any other type of vehicle that includes a motor/generator. The vehicle 102 may be an autonomous or semi-autonomous vehicle having self-driving capabilities.

The vehicle 102 may have one or more ECUs 116. A first ECU 116*a* and a second ECU 116*b* are shown in FIG. 2 by example. The one or more ECUs 116 may be programmed to control one or more operations of the vehicle 102. The one or more ECUs 116 may be implemented as a single ECU 116 or in multiple ECUs 116. The ECU 116 may be electrically coupled to some or all of the components of the vehicle 102. For example, the ECU 116 may be coupled to a memory 118 as shown in FIG. 2. In some embodiments, the ECU 116 may be a central ECU configured to control one or more operations of the entire vehicle 102. In some embodiments, the ECU 116 may be multiple ECUs located within the vehicle 102 and each configured to control one or more local operations of the vehicle 102. Multiple ECUs 116 may communicate with each other via a controller area network (CAN bus) system. For example, the first ECU 116*a* and the second ECU 116*b* may each have information (e.g., sensor data, video camera footage, etc.) that needs to be shared with each other and can prepare and broadcast the information via a CAN signal. The CAN signal may be accepted by the information receiving ECU 116. The information receiving ECU 116 may check the information to decide whether to obtain or ignore the information.

In some embodiments, the ECU 116 may be one or more computer processors or controllers configured to execute instructions stored in a non-transitory memory 118. The memory 118 may store machine-readable instructions usable by the ECU 116 and may store other data as requested by the ECU 116. The memory 118 may be a random-access memory (RAM), a disk, a flash memory, optical disk drives, a hybrid memory, or any other storage medium that can store data. The memory 118 may store data in an encrypted or any other suitable secure form.

In some embodiments, the server 114 may store data for the ECU 116. There may be a plurality of servers 114. The communication of the ECU 116 and the server 114 may be wireless. The data transmission may be provided via the Internet.

For example, the first ECU 116*a* may receive a CAN signal from the second ECU 116*a*. The CAN signal may provide information of a pressure of a tire of the vehicle 102. The first ECU 116*a* may encrypt the tire pressure or vehicle activity data and store the vehicle activity data in the memory 118 and/or the server 114. The first ECU 116*a* or the second ECU 116*b* may timestamp the vehicle activity data with the time the CAN signal was transmitted or received.

In another example, the CAN signal may provide information of an airbag deployment following an accident involving the vehicle 102. The first ECU may encrypt the airbag data or vehicle activity data and store the vehicle activity data in the memory 118 and/or the server 114. The first ECU 116*a* may timestamp the vehicle activity data with the time the CAN signal was transmitted or received. The timestamped vehicle activity data may serve as a record of when the accident occurred.

Figure 3:
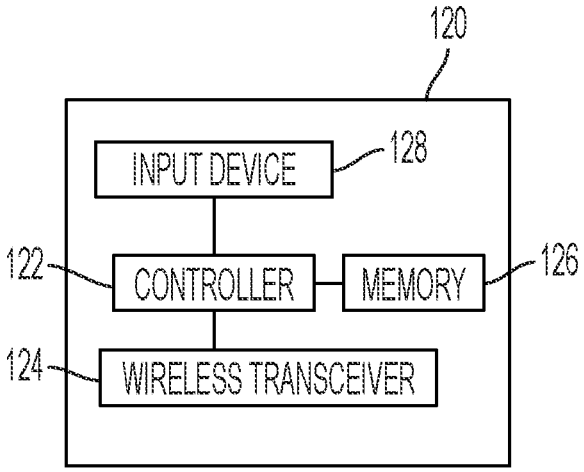
FIG. 3 illustrates a block diagram of the vehicle key, the user key, or the third-party key of FIG. 1 according to an aspect of the present disclosure.

FIG. 3 illustrates a block diagram of an exemplary key 120 that may be the vehicle key 104, the user key 108, or the third-party key 112 according to an aspect of the present disclosure. The key 120 may include a controller 122, a wireless transceiver 124, a memory 126, and an input device 128. In some embodiments, the key 120 may be a virtual key such as a password or a passcode including letters, numbers, shapes, patterns, symbols, etc.

The controller 122 may be one or more integrated circuits configured to control and manage the operations of the key 120. The controller 122 may include one or more processors configured to execute machine-readable instructions. The one or more processors may be microprocessors or microcontrollers by example. The controller 122 may be coupled to the wireless transceiver 124, the memory 126, and the input device 128.

The wireless transceiver 124 may include but is not limited to a Bluetooth, an IR, an RF, or a WiFi based communication hardware. In some embodiments, some or all of the aforementioned communication methods may be available for selection of a user of the key 120 based on preference or suitability (e.g., signal travel distance, signal availability, signal interference, signal travel speed, etc.). The wireless transceiver 124 may utilize another wireless communication technology appreciated by one of ordinary skill in the art.

The memory 126 may be a RAM, a disk, a flash memory, optical disk drives, a hybrid memory, or any other storage medium that can store data. The memory 126 may store program code that are executable by the controller 122. The memory 126 may store data in an encrypted or any other suitable secure form. In some embodiments, the key 120 may retrieve data from the server 114 (see FIG. 2) instead of or in addition to the memory 126.

The input device 128 may receive visual, auditory, and/or touch input. For example, the input device 128 may be a camera, a microphone, a touchscreen, a button, or a remote. The user of the key 120 may input commands and information into the input device 128 to control the controller 122. For example, the input device 128 may receive biometric information, the user's voice, and/or the user's touch input with one or more fingers.

Figure 4A:
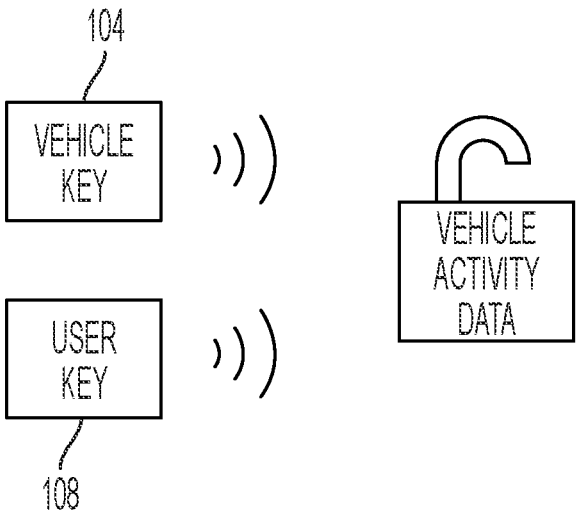
FIG. 4A illustrates a block diagram of the vehicle key and the user key of FIG. 1 being used to provide access to protected vehicle activity data according to an aspect of the present disclosure.

FIG. 4A illustrates a block diagram of the vehicle key 104 and the user key 108 being used to provide access to protected vehicle activity data according to an aspect of the present disclosure. When used together (i.e., simultaneously or sequentially), the vehicle key 104 and the user key 108 may view and/or modify vehicle activity data stored in the memory 118 and/or the server 114. For example, the user key 108 may send a request via the input device 128 (see FIG. 3) to access the vehicle activity data and the vehicle key 104 may approve or reject the request. The request may be sent to the ECU 116, the server 114, or the vehicle key 104 via the wireless transceiver 124. The ECU 116 or the server 114 may communicate the request to the vehicle key 104. In another example, the user key 108 may have first part of a key data required to access the vehicle activity data and the vehicle key 104 may have a second part of the key data required to access the vehicle activity data stored in the memory 126 (see FIG. 3). The key data may include numbers, text, symbols, code, and/or shapes. The user key 108 and the vehicle key 104 may transmit the first part of the key data and the second part of the key data simultaneously or sequentially to the ECU 116 or the server 114, respectively. The ECU 116 may decrypt the vehicle activity data stored in the memory 118 or the server 114 may decrypt the vehicle activity data it is storing. Once decrypted, the vehicle activity data may be viewed and/or modified. The viewing may be carried out via an output device native or external to the vehicle 102 (see FIG. 2), the vehicle key 104, or the user key 108. The output device may be capable of visually or auditorily communicating the vehicle activity data. For example, the output device may be a display or speakers. The modification may be carried out via the input device 128, an input device of the vehicle 102, or a computing device capable of receiving the vehicle activity data and transmitting the modified vehicle activity data to the memory 118 and/or the server 114. The modification may include changing, adding, subtracting, or deleting the vehicle activity data.

Figure 4B:
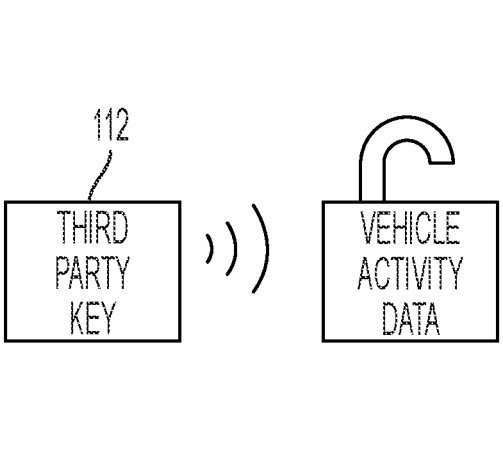
FIG. 4B illustrates a block diagram of the third-party key of FIG. 1 being used to provide access to protected vehicle activity data according to an aspect of the present disclosure.

FIG. 4B illustrates a block diagram of the third-party key 112 being used to provide access to protected vehicle activity data according to an aspect of the present disclosure. The third-party key 112 may view vehicle activity data stored in the memory 118 and/or the server 114. For example, the third-party key 112 may send a request via the input device 128 (see FIG. 3) to access the vehicle activity data and the vehicle key 104 may approve or reject the request. The request may be sent to the ECU 116, the server 114, or the vehicle key 104 via the wireless transceiver 124. The ECU 116 or the server 114 may communicate the request to the vehicle key 104. The third-party key 112 may have key data required to access the vehicle activity data stored in the memory 126 (see FIG. 3). The key data may include numbers, text, symbols, code, and/or shapes. The third-party key 112 may transmit the key data to the ECU 116 or the server 114. The ECU 116 may decrypt the vehicle activity data stored in the memory 118 or the server 114 may decrypt the vehicle activity data it is storing. Once decrypted, the vehicle activity data may be viewed. The viewing may be carried out via an output device native or external to the vehicle 102 (see FIG. 2) or the third-party key 112. The output device may be capable of visually or auditorily communicating the vehicle activity data. For example, the output device may be a display or speakers.

Figure 4C:
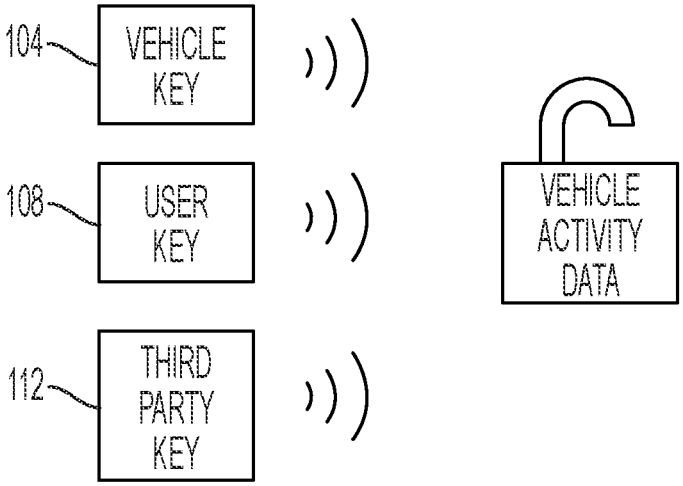
FIG. 4C illustrates a block diagram of the vehicle key, the user key, and the third-party key of FIG. 1 being used to provide access to protected vehicle activity data according to an aspect of the present disclosure.

FIG. 4C illustrates a block diagram of the vehicle key 104, the user key 108, and the third-party key 112 being used to provide access to protected vehicle activity data according to an aspect of the present disclosure. When used together (i.e., simultaneously or sequentially), the vehicle key 104, the user key 108, and the third-party key 112 may view and/or modify vehicle activity data stored in the memory 118 and/or the server 114. For example, the user key 108 may send a request via the input device 128 (see FIG. 3) to access the vehicle activity data, and the vehicle key 104 and the third-party key 112 may approve or reject the request. The request may be sent to the ECU 116, the server 114, or the vehicle key 104 and the third-party key 112. The ECU 116 or the server 114 may communicate the request to the vehicle key 104 and the third-party key 112. In another example, the user key 108 may have first part of a key data required to access the vehicle activity data, the vehicle key 104 may have a second part of the key data required to access the vehicle activity data, and the third-party key 112 may have a third part of the key data required to access the vehicle activity data stored in the memory 126 (see FIG. 3). The key data may include numbers, text, symbols, code, and/or shapes. The user key 108, the vehicle key 104, and the third-party key 112 may transmit the first part of the key data, the second part of the key data, and the third part of the key data simultaneously or sequentially to the ECU 116 or the server 114, respectively. The ECU 116 may decrypt the vehicle activity data stored in the memory 118 or the server 114 may decrypt the vehicle activity data it is storing. Once decrypted, the vehicle activity data may be viewed and/or modified. The viewing may be carried out via an output device native or external to the vehicle 102 (see FIG. 2), the vehicle key 104, the user key 108, and the third-party key 112. The output device may be capable of visually or auditorily communicating the vehicle activity data. For example, the output device may be a display or speakers. The modification may be carried out via the input device 128, an input device of the vehicle 102, or a computing device capable of receiving the vehicle activity data and transmitting the modified vehicle activity data to the memory 118 and/or the server 114. The modification may include changing, adding, subtracting, or deleting the vehicle activity data.

Figure 5:
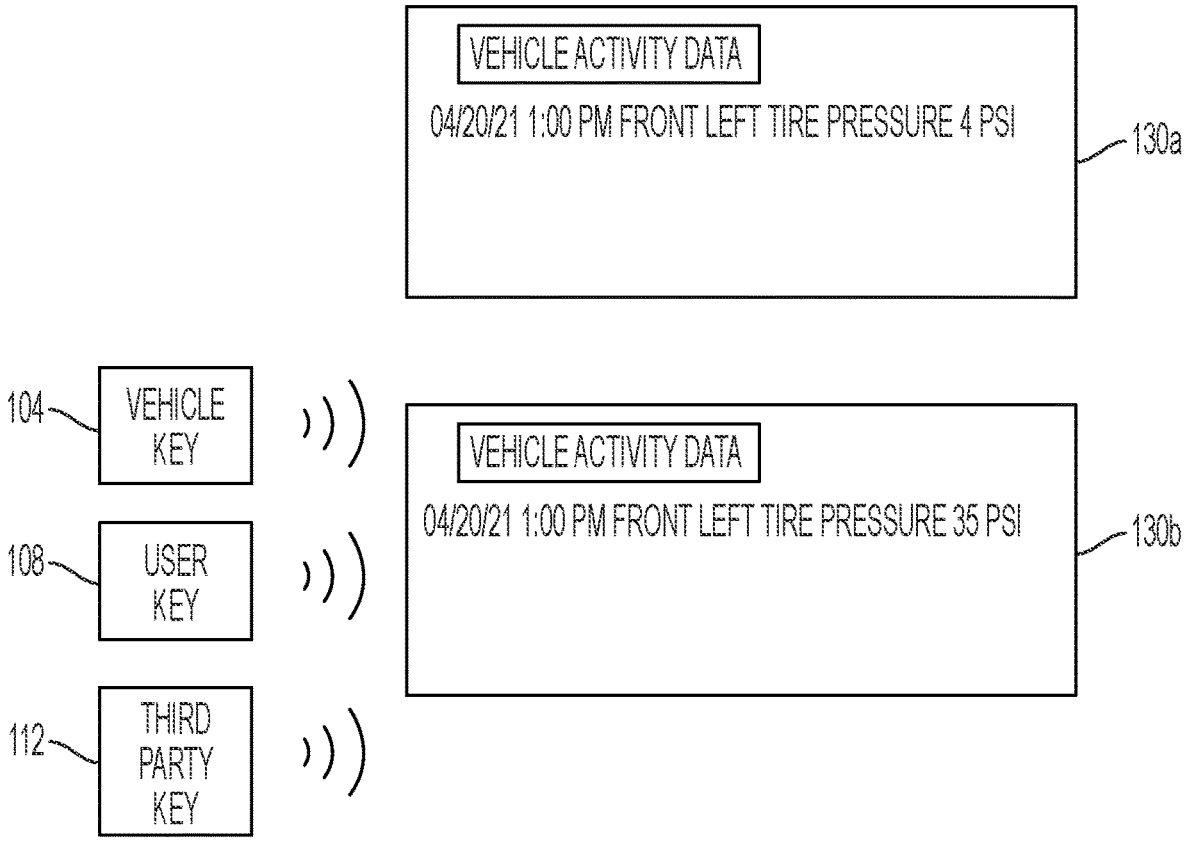
FIG. 5 illustrates a block diagram of the vehicle key, the user key, and the third-party key of FIG. 1 being used to modify protected vehicle activity data according to an aspect of the present disclosure.

FIG. 5 illustrates a block diagram of the vehicle key, the user key, and the third-party key of FIG. 1 being used to modify protected vehicle activity data according to an aspect of the present disclosure. The vehicle activity data is shown as being displayed on a display 130 in FIG. 5 by example. For example, the vehicle 102 (see FIG. 2) may have been in an accident and the manufacturer 100 (see FIG. 1) and the user 106 (see FIG. 1) or the third-party 110 (see FIG. 1) may use their respective keys to view the vehicle activity data. The display 130*a* shows a front left tire pressure at four (4) pound-force per square inch (psi) for a certain time, Apr. 20, 2021 at 1 o'clock, by example. After investigation, the manufacturer 100, the user 106, and/or the third-party 110 may determine that the tire pressure sensor was not functioning properly at that time, and thus measured a false tire pressure. If the manufacturer 100, the user 106, and the third-party 110 come to an agreement that the tire pressure sensor measured a false tire pressure, they may user their respective keys to modify the vehicle activity data to the actual tire pressure that should have been measured and recorded to correct the record as shown in FIG. 5. Thus, the parties may accurately keep record and determine the cause of the accident In some embodiments, only the manufacturer 100 and the user 106 may come to an agreement that the tire pressure sensor measured a false tire pressure and may user their respective keys to modify the vehicle activity data to the actual tire pressure that should have been measured and recorded to correct the accident record and accurately determine the cause of the accident. The display 130*b* shows a modified front left tire pressure at thirty-five (35) psi for the same time displayed on display 130*a*.

Figure 6:
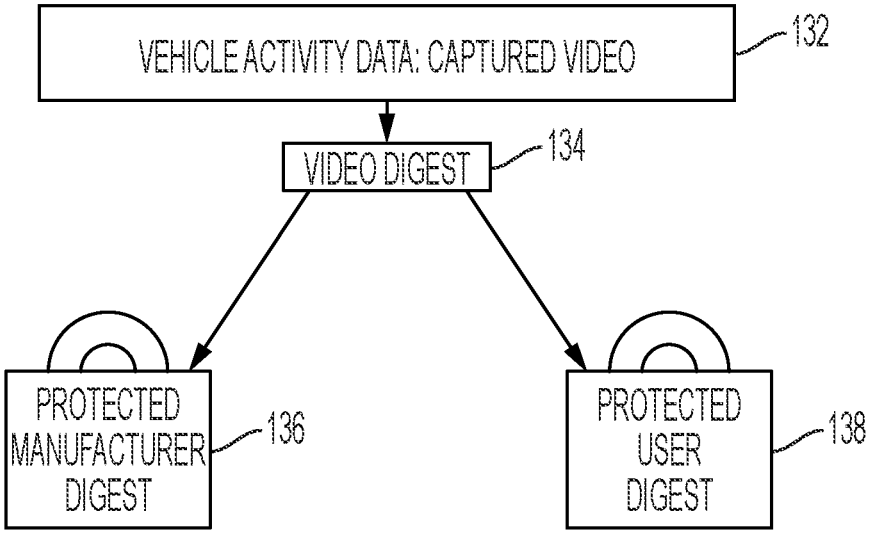
FIG. 6 illustrates a flowchart of protecting vehicle activity data according to an aspect of the present disclosure.

FIG. 6 illustrates a flowchart of protecting vehicle activity data according to an aspect of the present disclosure. The vehicle activity data may be a captured video footage 132. For example, there may be one or more cameras or optical sensors inside and/or outside the vehicle 102 (see FIG. 2) connected to the ECU 116 (see FIG. 2). The ECU 116 may assign a video identification (ID) to the captured video footage and include date, time, location, and other metadata. The ECU 116 may create a video digest 134 from the captured video footage 132. The video digest 134 may include a vehicle 102 or component (e.g., camera, sensor, etc.) ID assigned by the ECU 116 to associate with the video digest 134. The video digest 134 may be a compressed form of the captured video footage 132. Hence, the video digest 134 may occupy a smaller storage space compared to the captured video footage 132. The ECU 116 may then generate a protected manufacturer digest 136 and a protected user digest 138 from the video digest 134. Only the manufacturer 100 (see FIG. 1) may access the protected manufacturer digest 136 with the vehicle key 104 (see FIG. 1). Similarly, only the user 106 (see FIG. 1) may access the protected user digest 138 with the user key 108 (see FIG. 1). In some embodiments, a protected third-party digest may be generated and may be accessed by the third-party 110 (see FIG. 1) only with the third-party key 112 (see FIG. 1). The protected manufacturer digest 136 and the protected user digest 138 may each bear a watermark identifying that the digest is for the manufacturer only and the user only, respectively.

The captured video footage 132, the protected manufacturer digest 136, and the protected user digest 138 may be combined and stored in the memory 118 (see FIG. 2) or the server 114 (see FIG. 2). Any modification to the captured video footage 132 and/or the attached metadata may be unraveled by comparing the modified video footage to the protected manufacturer digest 136 and the protected user digest 138 by using the vehicle key 104 and the user key 108, respectively. The term "modified" may refer to cutting, changing, or appending any scene or data. Video digests may be generated from a modified captured video footage and/or the attached metadata; however, the protected manufacturer digest 136 or the protected user digest 138 may not be generated again without the vehicle key 104 or the user key 108, respectively. If the user 106 (see FIG. 1) modifies the captured video footage 132 and/or the attached metadata and generates a new modified protected user digest, the user 106 may try to use the modified captured video footage or the modified attached metadata as if original; however, the user 106 may not be able to recreate the protected manufacturer digest 136. Then, the manufacturer 100 (see FIG. 1) may claim the modified captured video footage and/or the modified attached metadata does not match the captured video footage 132 and/or the attached metadata.

Figure 7A:
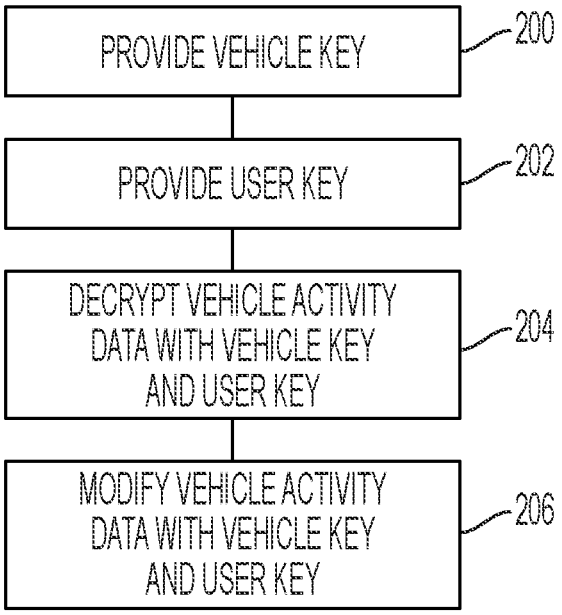
FIG. 7A illustrates a flowchart of a method for accessing protected vehicle activity data according to an aspect of the present disclosure.

FIG. 7A illustrates a flowchart of a method for accessing protected vehicle activity data according to an aspect of the present disclosure. The method may begin with block 200. In block 200, the method may include providing a vehicle key 104 (see FIG. 1). In block 202, the method may include providing a user key 108 (see FIG. 1).

In block 204, the method may include decrypting the vehicle activity data with the vehicle key 104 and the user key 108. When used together (i.e., simultaneously or sequentially), the vehicle key 104 and the user key 108 may decrypt the vehicle activity data stored in the memory 118 (see FIG. 2) and/or the server 114 (see FIG. 2). The ECU 116 (see FIG. 2) may decrypt the vehicle activity data stored in the memory 118 or the server 114 may decrypt the vehicle activity data it is storing based on the vehicle key 104 and the user key 108 instructions. Once decrypted, the vehicle activity data may be viewed.

In block 206, the method may conclude with modifying the vehicle activity data with the vehicle key 104 and the user key 108. The modification may be carried out via the input device 128 (see FIG. 3), an input device of the vehicle 102, or a computing device capable of receiving the vehicle activity data and transmitting the modified vehicle activity data to the memory 118 and/or the server 114. The modification may include changing, adding, subtracting, or deleting the vehicle activity data.

Figure 7B:
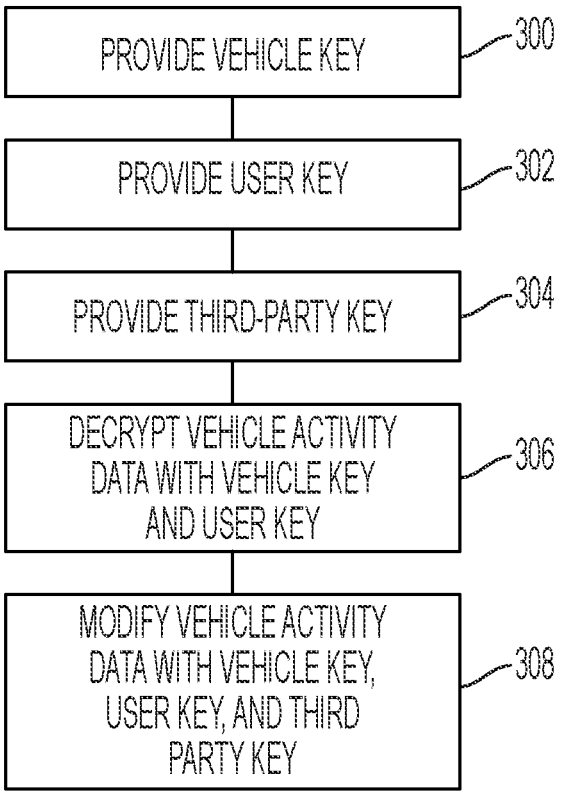
FIG. 7B illustrates a flowchart of a method for accessing protected vehicle activity data according to an aspect of the present disclosure.

FIG. 7B illustrates a flowchart of a method for accessing protected vehicle activity data according to an aspect of the present disclosure. The method may begin with block 300. In block 300, the method may include providing a vehicle key 104 (see FIG. 1). In block 302, the method may include providing a user key 108 (see FIG. 1). In block 304, the method may include providing a third-party key 112 (see FIG. 1).

In block 306, the method may include decrypting the vehicle activity data with the vehicle key 104 and the user key 108. When used together (i.e., simultaneously or sequentially), the vehicle key 104 and the user key 108 may decrypt the vehicle activity data stored in the memory 118 (see FIG. 2) and/or the server 114 (see FIG. 2). The ECU 116

(see FIG. 2) may decrypt the vehicle activity data stored in the memory 118 or the server 114 may decrypt the vehicle activity data it is storing based on the vehicle key 104 and the user key 108 instructions. Once decrypted, the vehicle activity data may be viewed. In some embodiments, the method may include decrypting the vehicle activity data with only the third-party key 112.

In block 308, the method may conclude with modifying the vehicle activity data with the vehicle key 104, the user key 108, and the third-party key 112. The modification may be carried out via the input device 128 (see FIG. 3), an input device of the vehicle 102, or a computing device capable of receiving the vehicle activity data and transmitting the modified vehicle activity data to the memory 118 and/or the server 114. The modification may include changing, adding, subtracting, or deleting the vehicle activity data.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A system for accessing protected activity data of a vehicle comprising:

a vehicle key configured to be managed by a manufacturer of the vehicle;

a user key configured to be managed by a user of the vehicle and decrypt the vehicle activity data when used in conjunction with the vehicle key; and an electronic control unit (ECU) configured to generate a digest data from the vehicle activity data, the digest data used in detecting unauthorized modification of the vehicle activity data by the manufacturer, the user, or a third-party, and the digest data including a protected user digest accessible by the user and a protected manufacturer digest accessible by the manufacturer.

2. The system of claim 1, wherein the ECU is further configured to register the vehicle activity data onto a memory or a server.

3. The system of claim 2, wherein the ECU is further configured to encrypt the vehicle activity data.

4. The system of claim 3, wherein the ECU is further configured to timestamp the vehicle activity data.

5. The system of claim 1, wherein the vehicle key and the user key are further configured to modify the vehicle activity data when used together.

6. The system of claim 1, further comprising a third-party key configured to be managed by the third-party and decrypt the vehicle activity data.

7. The system of claim 1, wherein the vehicle activity data includes driving footage, vehicle information, or accident information.

8. The system of claim 1, wherein the digest data is protected by the vehicle key and the user key, the protected user digest is protected from the vehicle manufacturer and accessible using the user key, and the protected manufacturer digest is protected from the user and accessible using the vehicle key.

9. A system for accessing protected activity data of a vehicle comprising:

a vehicle key configured to be managed by a manufacturer of the vehicle and protected from a user of the vehicle; and a user key configured to be managed by the user of the vehicle and protected from the manufacturer of the vehicle.

10. The system of claim 9, further comprising an electronic control unit (ECU) configured to register the vehicle activity data onto a memory or a server.

11. The system of claim 9, further comprising a third-party key configured to be managed by a third-party and modify the vehicle activity data when used in conjunction with the vehicle key and the user key, and the third-party key is further configured to decrypt the vehicle activity data.

12. The system of claim 9, wherein the vehicle key and the user key are further configured to decrypt the vehicle activity data when used together.

13. The system of claim 9, wherein the vehicle activity data includes driving footage, vehicle information, or accident information.

14. A method for accessing protected vehicle activity data comprising:

providing a vehicle key configured to be managed by a manufacturer of the vehicle;

providing a user key configured to be managed by a user of the vehicle;

generating, by an electronic control unit (ECU), a digest data from the vehicle activity data, the digest data used in detecting unauthorized modification of the vehicle activity data by the manufacturer, the user, or a third-party, the digest data includes a protected user digest accessible by the user and a protected manufacturer digest accessible by the manufacturer; and decrypting, by the vehicle key and the user key, the vehicle activity data.

15. The method of claim 14, further comprising, modifying, by the vehicle key and the user key, the vehicle activity data.

16. The method of claim 14, further comprising, providing a third-party key configured to be managed by the third-party, and modifying, by the vehicle key, the user key, and the third-party key, the vehicle activity data.

17. The method of claim 14, further comprising, registering, by the ECU, the vehicle activity data onto a memory or a server.

18. The method of claim 17, further comprising, encrypting, by the ECU, the vehicle activity data.

19. The method of claim 18, further comprising, timestamping, by the ECU, the vehicle activity data.

20. The system of claim 9, further comprising an electronic control unit (ECU) configured to generate a digest data from the vehicle activity data, the digest data used in detecting unauthorized modification of the vehicle activity data by the manufacturer, the user, or a third-party, and the digest data comprises a protected user digest accessible by the user and a protected manufacturer digest accessible by the manufacturer.

* * * * *